US006086147A

United States Patent [19]

Gladstone

[11] Patent Number: 6,086,147

[45] Date of Patent: Jul. 11, 2000

[54] STANDARD CHAIR TO ROCKING CHAIR ADAPTER

[76] Inventor: Paul Gladstone, 175 W. Putnam Ave., Greenwich, Conn. 06830

[21] Appl. No.: 09/048,383

[22] Filed: Mar. 26, 1998

[51] Int. Cl.[7] ..... A47C 13/00

[52] U.S. Cl. ..... 297/133; 297/272.1

[58] Field of Search ..... 297/130, 133, 297/272.1, 463.1

[56] References Cited

U.S. PATENT DOCUMENTS

| | | | |
|---|---|---|---|
| 187,389 | 2/1877 | Kamerer | 297/133 |
| 403,773 | 5/1889 | Pahlow | 297/272.1 X |
| 921,813 | 5/1909 | Druhman | 297/133 |
| 5,702,152 | 12/1997 | Shaw | 297/133 |
| 5,833,307 | 11/1998 | Leach et al. | 297/133 |

*Primary Examiner*—Peter R. Brown
*Attorney, Agent, or Firm*—Handal & Morofsky

[57] ABSTRACT

A unit for converting a conventional chair into a rocking chair is disclosed. The conversion unit includes a pair of rocker assemblies, each having a right and left rocker member. The rocker members are positioned facing each other thereby forming a receiving volume capable of housing the legs of the conventional chair. The lower portion of the receiving volume is configured to have a longitudinal groove. The legs of the conventional chair are fitted with an elongated protruding member dimensioned to fit within the groove, and prevent the movement of the chair in relationship to the rocking assembly.

9 Claims, 5 Drawing Sheets

STANDARD CHAIR TO ROCKING CHAIR ADAPTER

TECHNICAL FIELD

The present invention relates to an assembly which can attach to the legs of a conventional chair, thereby providing the user with rocking capability.

BACKGROUND

Languishing in a rocking chair has been a long time source of relaxation an entertainment. However the majority of chairs on the market today can be classified as "standard" or chairs lacking the ability to rock back and forth. Therefore, much effort has been devoted to the development of an adapter which can convert a standard chair into a rocking chair. The desirable qualities of such a device fall into several categories including safety, durability, versatility, ease of conversion and convenience of use.

Many attempts have been made over the years to develop a conversion unit which can embody the above mentioned desirable qualities while still being affordable by the average consumer. Generally, these designs have been cumbersome to assemble, massive, and beyond the reasonable price range of any potential consumer.

For example, Clough (U.S. Pat. No. 4,126,353) is directed to a conversion unit for converting an ordinary standard chair into a rocking chair. However, a disadvantage of the device of the Clough patent is that the conversion unit disclosed has one piece rocker construction requiring the use of a telescoping brace between the two rockers in order to stabilize the assembly. This design is not advantageous to the user as it is difficult to assemble the telescoping braces required to stabilize the unit.

Clark (U.S. Pat. No. 2,612,489) discloses a rocker attachment for converting a stationary folding lawn chair, of tubular construction, into a rocking chair. This design, however, can only be utilized with chairs, preferably "lawn" chairs, of tubular construction. This unit is simply not an efficient means for conversion of a standard chair into a rocking chair.

Benzur (U.S. Pat. No. 5,013,086) discloses a device for converting a piece of furniture, such as a baby's crib, into a rocker. The conversion is accomplished by use of a one piece rocker, having a plurality of leg recesses in which the legs of a crib are placed. A disadvantage of the invention is that the rocker is not affixed to the leg of the crib thereby creating an unsafe and unstable condition.

Lerner (U.S. Pat. No. 5,246,268) directed to a device that attaches to the legs of a chair, by the use of straps which encircled the chair seat, thereby converting a standard chair into a rocking chair. This assembly, however, is difficult and cumbersome to assemble and operate. Another disadvantage of this invention is that the necessary straps are displeasing to the eye and can take away from the aesthetics of a chair.

The aforementioned references are directed to a device which can convert a Standard chair into a rocking chair. There continue to be improvements made in the design of such devices, with the objects of minimizing the difficulty of assembly and simplifying the design while still providing sufficient stability and safety for the user.

The devices for conversion of a Standard chair to a rocking chair now available on the market, such as those noted above, provide varying degrees of dual operation. This feature however, is gained at the expense of safety, stability, ease of installation and overall esthetic appeal. In accordance with the present invention, these and other disadvantages of the prior art are minimized. The present invention provides a new and useful improvement on the traditional design of a Standard chair to rocking chair conversion device.

SUMMARY OF THE INVENTION

The invention, as claimed, is intended to provide an improved standard chair to rocking chair adapter. The present invention affords the user the ability to convert a standard chair into a rocking chair with a minimum of inconvenience and expense while still providing a safe and stable chair.

The preferred embodiment of the present invention comprises a Pair of arcuate rocking elements. Each of said rocking elements is configured in two pieces. When the two pieces are secured to one another a receiving area is formed. This receiving area runs along the length of the rocking assembly, and provides a volume which can house the legs of the conventional chair. Along the lower portion of the receiving area is a groove.

Each of the legs of the conventional chair is fitted with an elongated protruding member. The portion of said member that extends beyond the width of the chair is housed within the groove running along the lower portion of the receiving area. After the protruding member is secured within the groove the chair cannot move in relation to the rocking assembly.

BRIEF DESCRIPTION OF THE DRAWINGS

One way of carrying out the invention is described in detail below with reference to drawings which illustrate only one specific embodiment of the invention and in which.

DETAILED DESCRIPTION OF THE PREFERRED EMBODIMENTS

Figure 1:
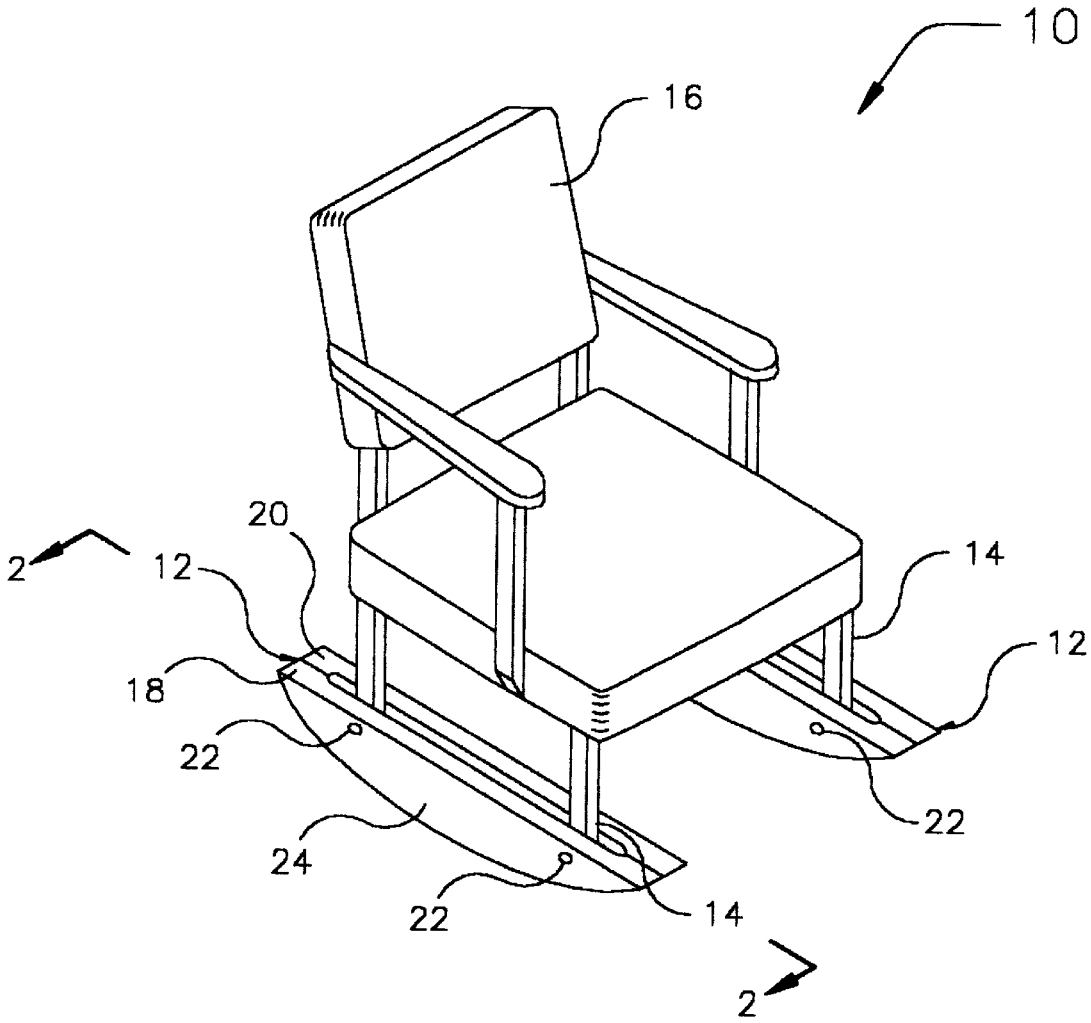
FIG. 1 is a perspective view of a standard chair to rocking chair conversion unit constructed in accordance with the preferred embodiment of the present invention shown attached to said standard chair.

Referring to FIG. 1, the inventive standard chair to rocking chair conversion unit is illustrated. Conversion unit 10 comprises a pair of rockers 12 which attach to the legs 14 of a Standard chair 16. Rockers 12 have a right rocker member 18 and a left rocker member 20. Rocker 12 can be constructed out of any material of sufficient strength to support chair 16, while still being lightweight enough to allow the user to manipulate the rocker members during assembly. Rocker 12 is preferably made of high strength plastic, however wood or metal can also be used.

Figure 2:
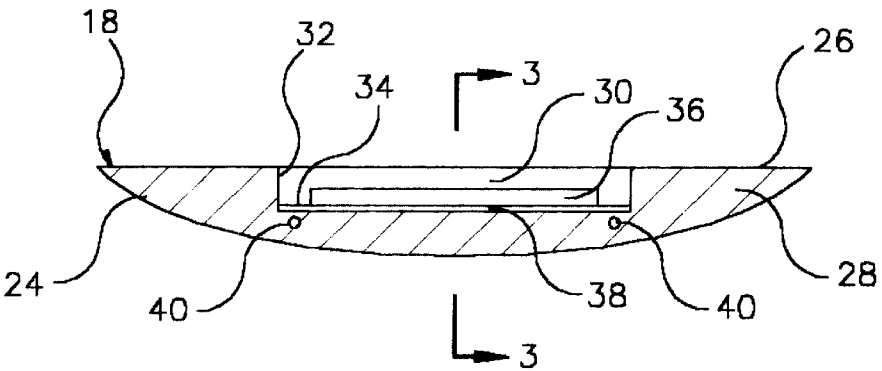
FIG. 2 is a side elevation of a rocker member taken along lines 2—2 of FIG. 1.

Right rocker member 18 and left rocker member 20 are mirror images of each other, which are held together by screws 22. As seen in FIG. 2, right rocker member 18 has a curved surface 24, an upper surface 26, and an inner surface 28. Right rocker member 18 also has a receiving area 30 which is defined by a pair of longitudinal sides 32, and a lower surface 34. Receiving area 30 is also configured with a groove 36, and a well 38.

Figure 3:
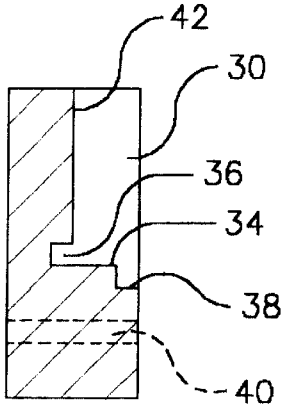
FIG. 3 is a cross sectional view of a rocker member taken along lines 3—3 of FIG. 2.

Right rocker member 18 also has a pair of holes 40 which can receive screws 22. FIG. 3 clearly shows groove 36 and well 38 of receiving area 30. Also shown is the side wall 42 of receiving area 30. Groove 36 is recessed into side wall 42. Well 38 is similarly recessed into lower surface 34 of receiving area 30. The actual dimensions of receiving area 30, and its components can vary to accommodate a wide variety of chair leg sizes and shapes.

Figure 4:
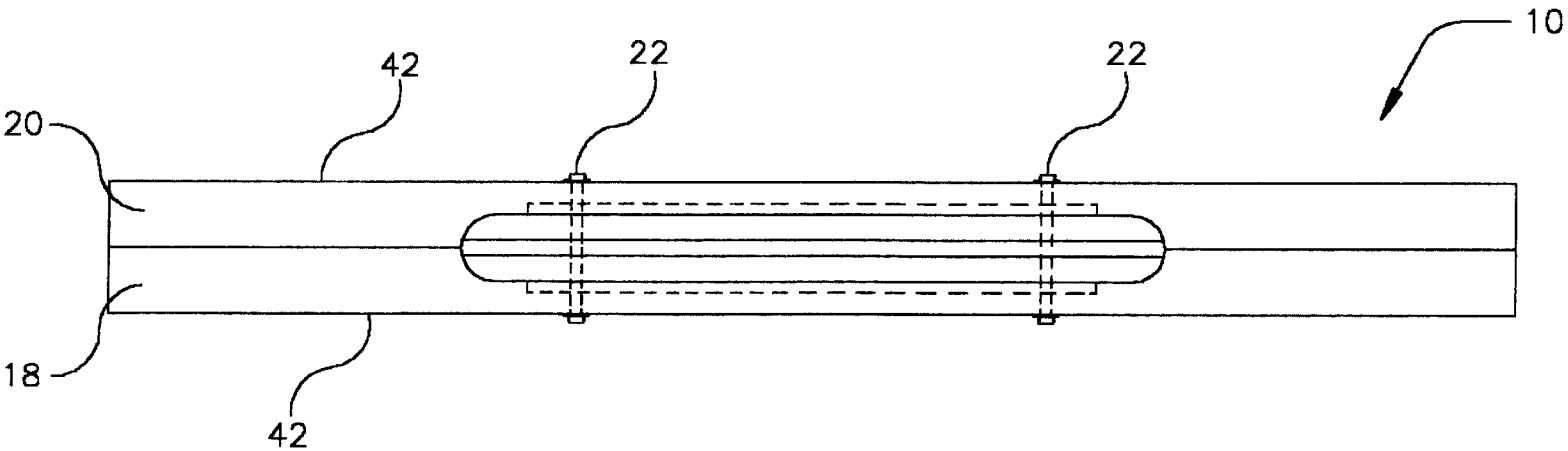
FIG. 4 is a top view of a conversion unit constructed in accordance with the preferred embodiment of the present invention.

FIG. 4 shows right rocker member 18 and left rocker member 20 of conversion unit 10 in their assembled positions. The two halves of conversion unit 10 are held together by screws 22 which pass through holes 40. Screws 22 can consist of a machine screw and wing-nut assembly utilizing a washer on the outer walls 42 of rocker members 18 and 20. Alternatively screws 22 may be held in place by a locking nut assembly or any other methods used in the industry.

Figure 5:
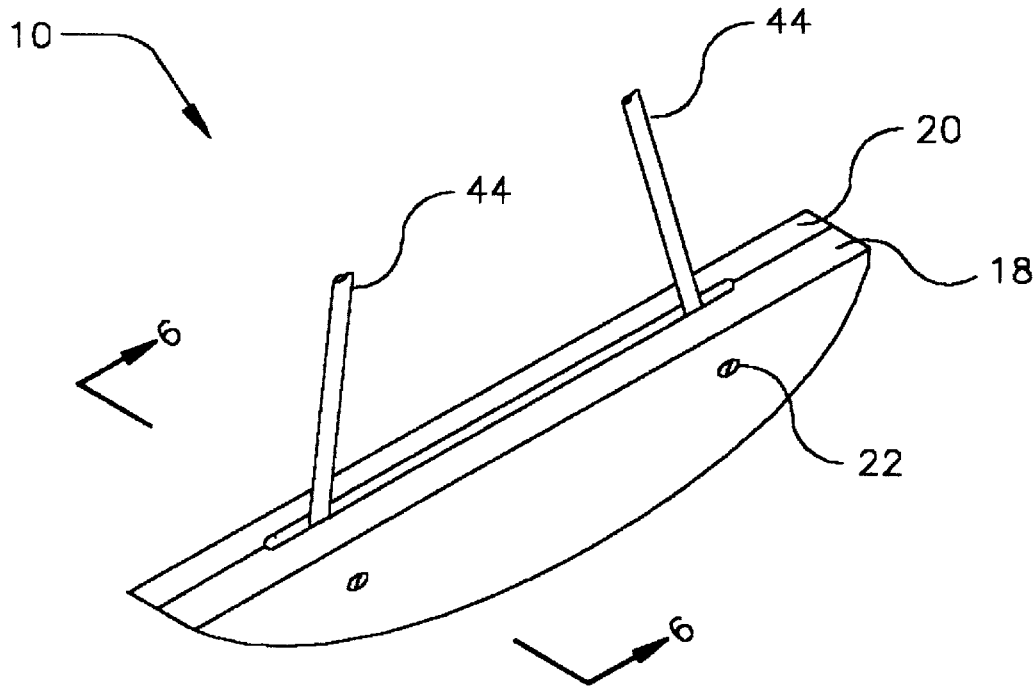
FIG. 5 is a perspective view of the conversion unit.

FIG. 5 shows the conversion unit 10 after assembly to a Standard chair leg 44. Chair leg 44 is shown having a round configuration, however the conversion unit can be adapted to fit a square leg or any other shape which may be used. The leg 44 is fitted with a bar 46. Bar 46 is attached to leg 44 by the use of a fastener 48.

Figure 6:
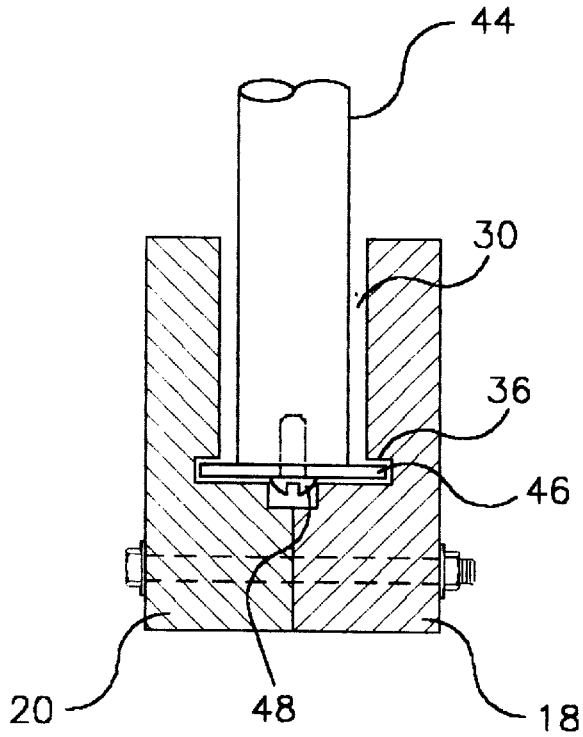
FIG. 6 is a cross sectional view of the conversion unit taken along section lines 6—6 of FIG. 5.

As shown in FIG. 6 the fastener 48 is in the form of a screw which is threaded into the leg 44. The illustrated use of a screw shall not preclude the use of a pinning, press, or tack welding, or any other manner of fastening. Bar 46 is wider than leg 44 and fits into groove 36 of receiving area 30. Similarly the head of fastener 48 fits into well 38 so that rocker members 18 and 20 join together without any interference.

When it is desired to fit a standard chair with the inventive conversion unit 10, the chair legs must be fitted with a bar 46. It is preferred that the chair have four legs which have solid portions at their feet. However this is only necessary if the user wishes to fasten bar 46 to leg 44 using a self tapping screw. The user can fasten bar 46 to leg 44 using the alternative methods mentioned above or any other method known in the industry. Once the chair is fitted with bar 46, rocker members 20 and 18 are then mated together such that bar 46 is placed within groove 36. The rocker members are then held together by use of screws 22 which pass through hole 40. This process forms rocker 12. This process is then repeated securing another rocker assembly 12 to the other two chair legs.

In order to accommodate a wide range of chair leg spans, groove 36 runs substantially the entire length of receiving area 30. The extended length of groove 36 allows for the differences found in the typical span of chair legs.

When in use the conversion unit 10 provides a stable base which enables the user to rock a standard chair back and forth. The curved portion 24 of rocker members 18 and 20 provides a smooth transition when the user shifts their weight from front to rear, on the chair. When the user shifts their weight into the back rest of the chair the tendency will be for the front legs of the chair to rise up out of receiving area 30. However the novel design of rocker assembly 12 prevents this from happening. Bar 46 which is situated in groove 36, and fastened to leg 44, will prevent the chair from moving in relation to the rockers.

Figure 7:
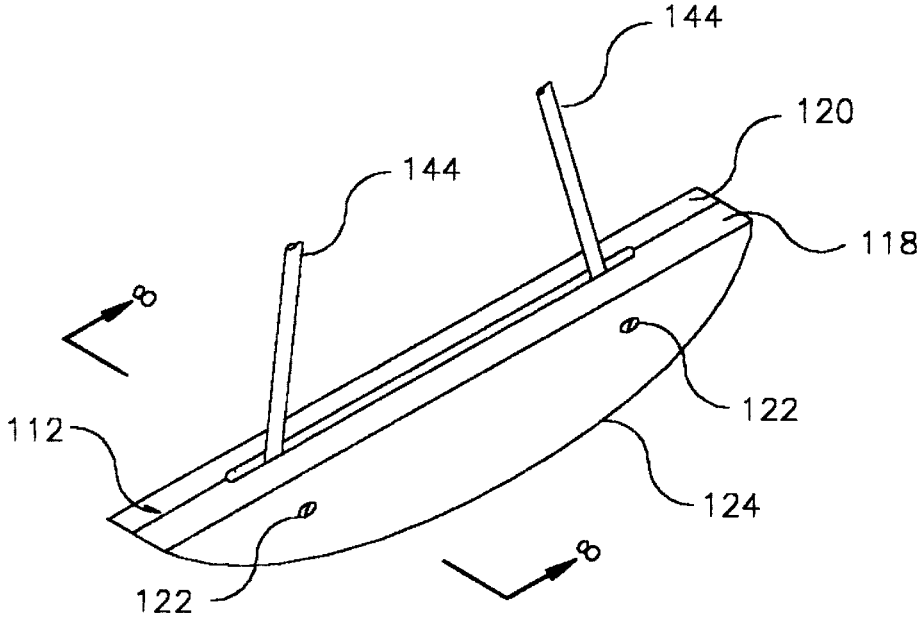
FIG. 7 is a perspective view of an alternative embodiment of the conversion unit.

In FIG. 7, an alternative embodiment of the present invention is illustrated. Generally similar components or parts performing analogous, corresponding or identical functions to those of the FIG. 1 embodiment are numbered herein with numerals which differ from the FIG. 1 embodiment by multiples of one hundred.

Referring now to FIG. 7 rocker assembly 112 has a right rocker member 118 and a left rocker member 113 which are held together by screws 122. Rocker assembly 112 holds chair legs 144 in place. The curved portion 124 of rocker members 118 and 120 allows the user to rock the chair back and forth by shifting their weight.

Figure 8:
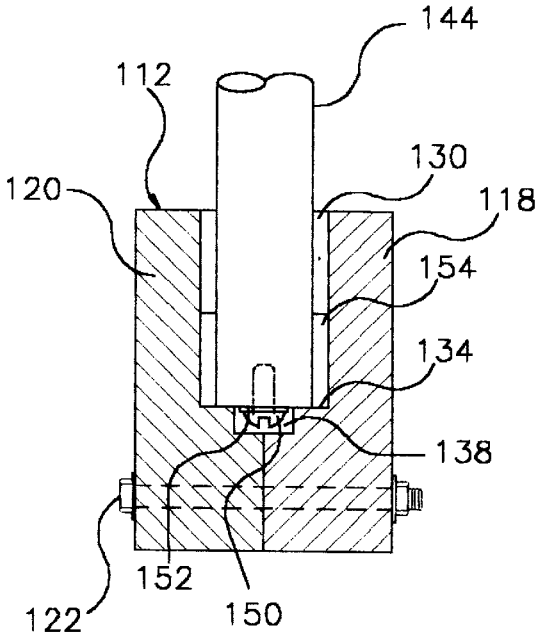
FIG. 8 is a cross sectional view of alternative embodiment of the conversion unit taken along section lines 8—8 of FIG. 7.

FIG. 8 depicts the alternative method of securing chair leg 144 within rocker assembly 112. As in the previous embodiment rocker members 118 and 140 are mirror images of one another. Each has a receiving area 130 a side wall 132, and a lower portion 134 which has a well 138.

Secured to the lower portion of leg 144 is a bracket 152 which is held in place by a fastener 150. Fastener 150 is preferably a self tapping screw, however any method known can be used to fasten bracket 152 to chair leg 144, such as aforementioned. Bracket 152 is held within rocker assembly 112 by use of an expansion stopper 154. Expansion stopper 154 is of the type which can be placed within receiving area 130 and then its size is expanded to wedge itself within rocker members 118 and 120. The use of expansion stopper 154 will prevent chair leg 144 from moving in relation to the rocker assembly 112.

Figure 9:
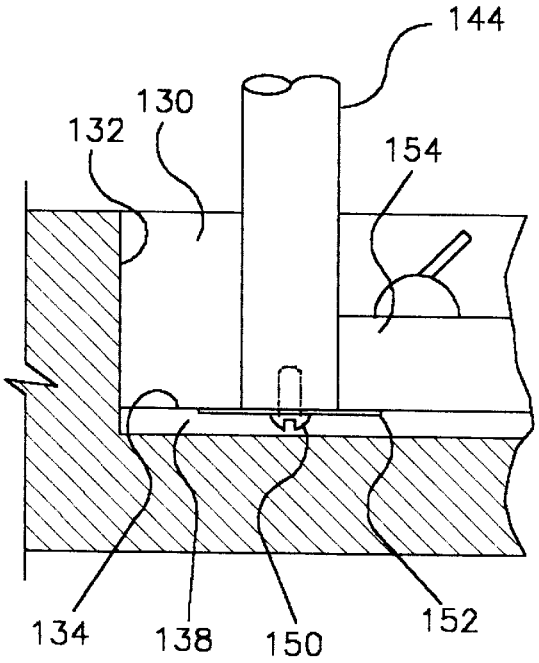
FIG. 9 is a partial elevation of the rocker element as constructed in accordance with the alternative embodiment of FIG. 7.

As shown in FIG. 9, bracket 152 has a greater length than the lower portion of leg 144. This allows expansion stopper 154 to rest on top of bracket 152, thereby preventing movement of leg 144 in relation to rocker assembly 112.

Figure 10:
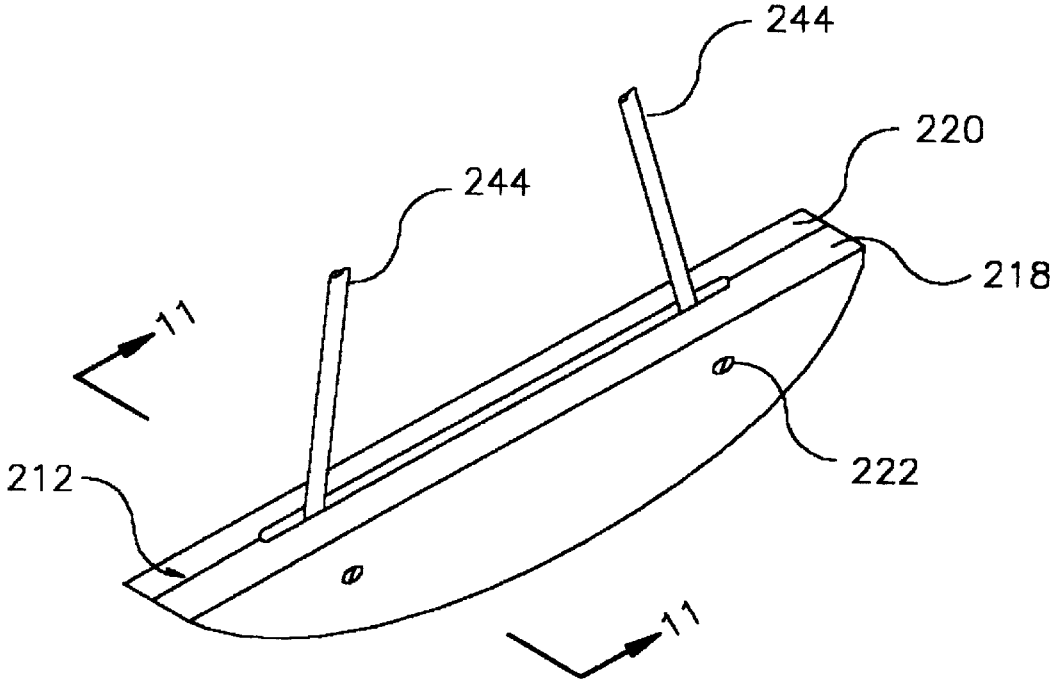
FIG. 10 is a perspective view of an alternative embodiment of the conversion unit.

In FIG. 10, another alternative embodiment of the present invention is illustrated. Generally similar components or parts performing analogous, corresponding or identical functions to those of the FIG. 1 embodiment are numbered herein with numerals which differ from the FIG. 1 embodiment by multiples of one hundred.

FIG. 10 shows yet another alternative embodiment of the present invention. Rocker assembly 212 has a right rocker member 218 and a left rocker member 220 which are held together by fasteners 222. Secured between the right and left rocker members is leg to 44.

Figure 11:
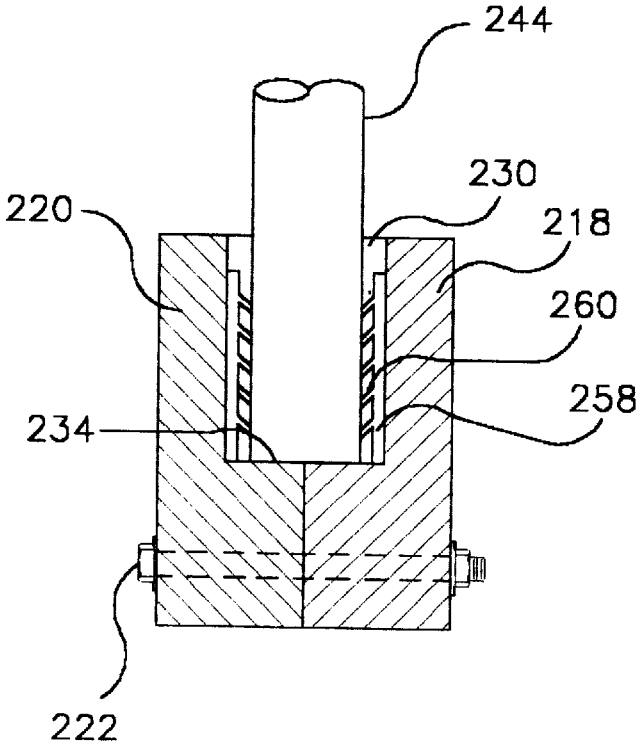
FIG. 11 is a cross sectional view of an alternative embodiment of the conversion unit taken along section lines 1—11 of FIG. 10.

As can be clearly seen in FIG. 11, leg 244 is held in place by grasping friction pads 258. Friction pads 258 have fins 260 which are angled downward to prevent leg 244 from sliding out of receiving area 230 when the chair is rocked. Friction pads 258 are constructed from any material such as rubber, which will prevent the slippage of leg 244, while at the same time preventing damage from occurring to leg 244.

While an illustrative embodiment of the invention has been described above, it is, of course, understood that various modifications will be apparent to those of ordinary skill in the art. Such modifications are within the spirit and scope of the invention, which is limited and defined only by the appended claims.

I claim:

1. A pair of rocker assemblies for attachment to a standard chair having four legs, to convert said standard chair into a rocking chair, each of said rocker assemblies, comprising:

(a) a right rocker element, said right rocker element having an inner left side, an outer right side, a top side, and a curved bottom surface, said right rocker element comprising:

(i) a right sidewall defined in said inner left side of said right rocker element;

(ii) a right chair leg support surface defined in said inner left inside of said right rocker element and extending substantially transverse to said right sidewall in said right rocker element, and from said right sidewall to the inner most portions of said left side of said right rocker element;

(iii) a right rocker element support surface comprising said curved bottom surface of said right rocker element and being substantially transverse to said chair leg support surface extending downwardly therefrom;

(b) a left rocker element, said left rocker element having an inner right side, an outer left side, a top side, and a curved bottom surface, said left rocker element being positioned with respect to said right rocker element with said inner right side of said left rocker element in facing relationship to said inner left side of said right rocker element, said left rocker element comprising:

(i) a left sidewall defined in said inner right side of said left rocker element;

(ii) a left chair leg support surface defined in said inner right inside of said left rocker element and extending substantially transverse to said left sidewall in said left rocker element, and from said left sidewall to the inner most portions of said right side of said left rocker element;

(iii) a left rocker element support surface comprising said curved bottom surface of said left rocker element and being substantially transverse to said chair leg support surface extending downwardly therefrom, said right sidewall, said left sidewall, said right chair leg support surface and said left chair leg support surface together defining a receiving volume having a width, a length, and a depth, said width being defined between said right and left sidewalls of said right and left rocker elements, and said length being sufficient to allow the housing of two of the chair legs of said chair in said receiving volume;

(c) a right groove defined longitudinally within said right sidewall;

(d) a left groove defined longitudinally within said left sidewall; and (e) a plurality of protruding engagement members for attachment to the bottom of each of said chair legs, each of said engagement members extending beyond said receiving volume, and said engagement members being engaged by said right and left grooves defined longitudinally within said right and left sidewalls, said grooves and said engagement members being configured, positioned and dimensioned to restrict movement of said engagement members and the bottoms of said chair legs in relation to said rocker assembly.

2. A kit for converting a standard chair having four legs into a rocking chair, comprising: two substantially similar rocker assemblies each being formed by two substantially similar rocker elements, each of said rocker assemblies comprising:

a) a curved bottom surface;

b) a chair leg support surface;

c) a receiving area having a length, width, and depth and extending into said rocker assembly, the width of said receiving area being substantially defined by a left receiving area sidewall and a right receiving area sidewall and the depth of said receiving area being substantially defined by the distance from the uppermost parts of said left and right receiving area sidewalls to said chair leg support surface, said receiving area comprising a volume within said rocker assembly sufficiently large enough to allow insertion of two of four of said chair legs; and d) recessed grooves defined longitudinally within said right and left receiving area sidewalls having a volume sufficient to allow engagement of a plurality of protruding engagement members releasably attachable to the bottom of each of said chair legs, said engagement members protruding substantially perpendicularly away from the planar surface of said chair legs and beyond said right and left receiving area sidewalls into said recessed grooves.

3. A kit according to claim 2, whereby said rocker elements are constructed from wood.

4. A kit according to claim 2, whereby said rocker elements are constructed from plastic.

5. A kit according to claim 2, wherein said rocker elements are secured together to form a rocker assembly by engaging at least one fastener substantially transversely through each of said rocker elements.

6. A kit for converting a standard chair having four legs into a rocking chair, comprising: two substantially similar rocker assemblies having two substantially similar rocker elements attached together, each of said rocker assemblies comprising:

a) a curved bottom surface;

b) a chair leg support surface;

c) a receiving area having a length, width, and depth and extending into said rocker assembly, the width of said receiving area being substantially defined by a left receiving area sidewall and a right receiving area sidewall and the depth of said receiving area being substantially defined by the distance from the uppermost parts of said left and right receiving area sidewalls to said chair leg support surface, said receiving area comprising a volume within said rocker assembly sufficiently large enough to allow insertion of two of four of said chair legs; and d) a recessed groove defined longitudinally within said right and left receiving area sidewalls having a volume sufficient to allow engagement of a plurality of protruding engagement members releasably attachable to the bottom of each of said chair legs, said engagement members protruding substantially perpendicularly away from the planar surface of said chair legs and beyond said right and left receiving area sidewalls into said recessed grooves;

e) a fastener for releasably attaching said protruding engagement member to said chair leg, said fastener having a first end and a second end, said first end capable of being inserted through said protruding engagement member and into the bottom of said chair leg and said second end being wider than said first end; and f) a recessed well defined longitudinally within said bottom receiving area surface, configured, dimensioned and positioned to have a volume sufficient to accommodate said second end of said fastener.

7. A kit according to claim 6, whereby said rocker elements are constructed from wood.

8. A kit according to claim 6, whereby said rocker elements are constructed from plastic.

9. A kit according to claim 6, wherein said rocker elements are secured together to form a rocker assembly by engaging at least one connecting element substantially transversely through each of said rocker elements.

* * * * *